US006176063B1

(12) United States Patent
Warin

(10) Patent No.: US 6,176,063 B1
(45) Date of Patent: Jan. 23, 2001

(54) PANEL LIFTER WITH ANTIDROP PROTECTION

(75) Inventor: André Warin, L'Albenc (FR)

(73) Assignee: Tradition de l'Outil a Main T.O.M., Vinay (FR)

( * ) Notice: Under 35 U.S.C. 154(b), the term of this patent shall be extended for 0 days.

(21) Appl. No.: 09/259,893

(22) Filed: Feb. 27, 1999

(51) Int. Cl.[7] ..... E04F 21/00

(52) U.S. Cl. ..... 52/749.1; 59/127.2; 59/122.1; 59/DIG. 1

(58) Field of Search ..... 52/749.1, 127.2, 52/122.1, DIG. 1; 269/55, 86

(56) References Cited

U.S. PATENT DOCUMENTS 5,913,783 * 6/1999 Weener et al. ..... 52/749.1

FOREIGN PATENT DOCUMENTS

1237967 * 6/1960 (FR) ..... 52/749.1
1377926 * 9/1964 (FR) ..... 52/749.1
2538437 * 12/1982 (FR) ..... 52/749.1
2552478 * 9/1983 (FR) ..... 52/749.1
2623546 * 11/1987 (FR) ..... 52/749.1

* cited by examiner

*Primary Examiner*—Carl D. Friedman
*Assistant Examiner*—Dennis L. Dorsey

(57) ABSTRACT

A panel lifter has a base, a mast extending upward from the base and including at least one lower section fixed in the base and at least one movable section telescoping with the lower section and having a laterally directed section face, a panel-support rack mounted at an upper end of the mast, and a crank mechanism on the base and a cable connected between the mechanism and the mast for vertically extending the mast by raising the movable mast section upward relative to the base. A brake jaw at an upper end of the lower section has a jaw face and is pivotal about a horizontal axis below the jaw face between a braking position with the jaw face bearing laterally on the section face and a freeing position with the jaw face pivoted back out of contact with the section face. An actuating handle projecting generally radially of the axis from the jaw is provided so that the jaw can be moved between its positions via the handle. A biasing system urges the jaw into the braking position.

6 Claims, 2 Drawing Sheets

51
48
45
12
34
32
36
F
49
43
44
46
38
50
11
2
37
41
35
33
39
31
40
47'
52
47
42
50
10

PANEL LIFTER WITH ANTIDROP PROTECTION

FIELD OF THE INVENTION

The present invention relates to a panel lifter. More particularly this invention concerns a panel lifter with antidrop protection.

BACKGROUND OF THE INVENTION

A standard panel lifter used, for instance, to raise gypsum sheets and hold them against ceiling joists while they are nailed or screwed to the joists, normally has a base, a mast extending upward from the base and including at least one lower section fixed in the base and at least one movable section telescoping with the lower section and having a laterally directed section face, a panel-support rack mounted at an upper end of the mast, and a crank mechanism on the base and a cable connected between the mechanism and the mast for vertically extending the mast by raising the movable mast section upward relative to the base. The rack can normally pivot at least limitedly about a horizontal axis so that the panel can be pressed against a ceiling that is inclined to the horizontal. Such devices are described in French patents 1,237,967, 2,308,760, 2,538,437, 2,552,478, and 2,623,546.

A particular hazard with such machines is that if the cable or crank mechanism fails, the panel, which can weigh in the neighborhood of 100 lbs for a 12-ft sheet of firecode gypsum board, and the rack will drop precipitously and can seriously injure the workers who are perforce underneath. The problem is compounded by the fact that it is standard to tension the cable and stress the crank mechanism considerably by pressing the panel tightly against the ceiling joists so that it can be easily attached in place.

Thus above-cited French patent 2,538,437 proposes a system where the mast is provided with an antidrop system. Two such devices are provided which act respectively between the lower and middle and between the middle and upper sections of the normally three-part mast. Such a system comprises a wedge that can pivot on the respective mast section and that is urged into a position wedged between the mast sections by a spring, while the cable, when tensioned, holds it out of contact with the mast sections. Thus if the cable breaks, the spring pushes the wedge into position to inhibit relative sliding of the respective mast sections.

The disadvantage of this system is that it often cannot provide sufficient braking force when a particularly heavy panel is being lifted, mainly because it only contacts the section it is intended to brake over a relatively limited surface area. In addition the brake is relatively expensive and complex. Furthermore since it is built in, inside the mast, it is not apparent to the user and gives no assurance that it is there and working.

In addition German utility model 295 01 130 and French patent 1,377,926 describe mast blocking systems describe systems not intended for use with crank-operated system, but instead have a pivotal latching member traversed by the math and making in effect point contact with the mast. These systems are mainly aimed at resisting horizontal stresses and are not aimed at providing antidrop action. They are not readily installed on a panel lifter.

OBJECTS OF THE INVENTION

It is therefore an object of the present invention to provide an improved panel lifter.

Another object is the provision of such an improved panel lifter which overcomes the above-given disadvantages, that is which has an improved antidrop system.

SUMMARY OF THE INVENTION

A panel lifter has a base, a mast extending upward from the base and including at least one lower section fixed in the base and at least one movable section telescoping with the lower section and having a laterally directed section face, a panel-support rack mounted at an upper end of the mast, and a crank mechanism on the base and a cable connected between the mechanism and the mast for vertically extending the mast by raising the movable mast section upward relative to the base. According to the invention a brake jaw at an upper end of the lower section has a jaw face and is pivotal about a horizontal axis below the jaw face between a braking position with the jaw face bearing laterally on the section face and a freeing position with the jaw face pivoted back out of contact with the section face. An actuating handle projecting generally radially of the axis from the jaw is provided so that the jaw can be moved between its positions via the handle. A biasing system urges the jaw into the braking position.

With the system of this invention the brakes are therefore always in effect. Unless manually operated, they will block dropping of the mast so that the user is obligated to actuate the release lever in order to lower the panel rack. Thus the system will respond to failure of the crank mechanism or of the cable. Even if the cable remains taut, for instance if it breaks but remains pinched somewhere, the one-way brakes of this invention will be effective. In fact the system is particularly effective for lowering the panel since the operator can simply release the latch dog of the crank and then, by operating the release levers of the antidrop mechanisms, rapidly lower the mast.

According to the invention the lower section has at its upper end a collar on which the jaw is pivoted. In addition the biasing unit includes at least one tension spring having an upper end engaged with the jaw above the axis and a lower end connected to the lower section below the axis. Alternately the biasing unit includes a counterweight mounted on the jaw.

The lower section in accordance with the invention has at its upper end a collar on which the jaw is pivoted and carrying at least one wheel over which the cable is reeved. There is, nonetheless, no functional connection between the cable and the brake.

With the system of this invention two such brakes of substantially identical construction are provided, one between the lower mast section and the middle mast section, and the other between the middle mast section and the upper mast section. This extremely simple structure makes the panel lifter very safe and quite easy to use. Its operation and existence are obvious to the user who can easily operate it.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
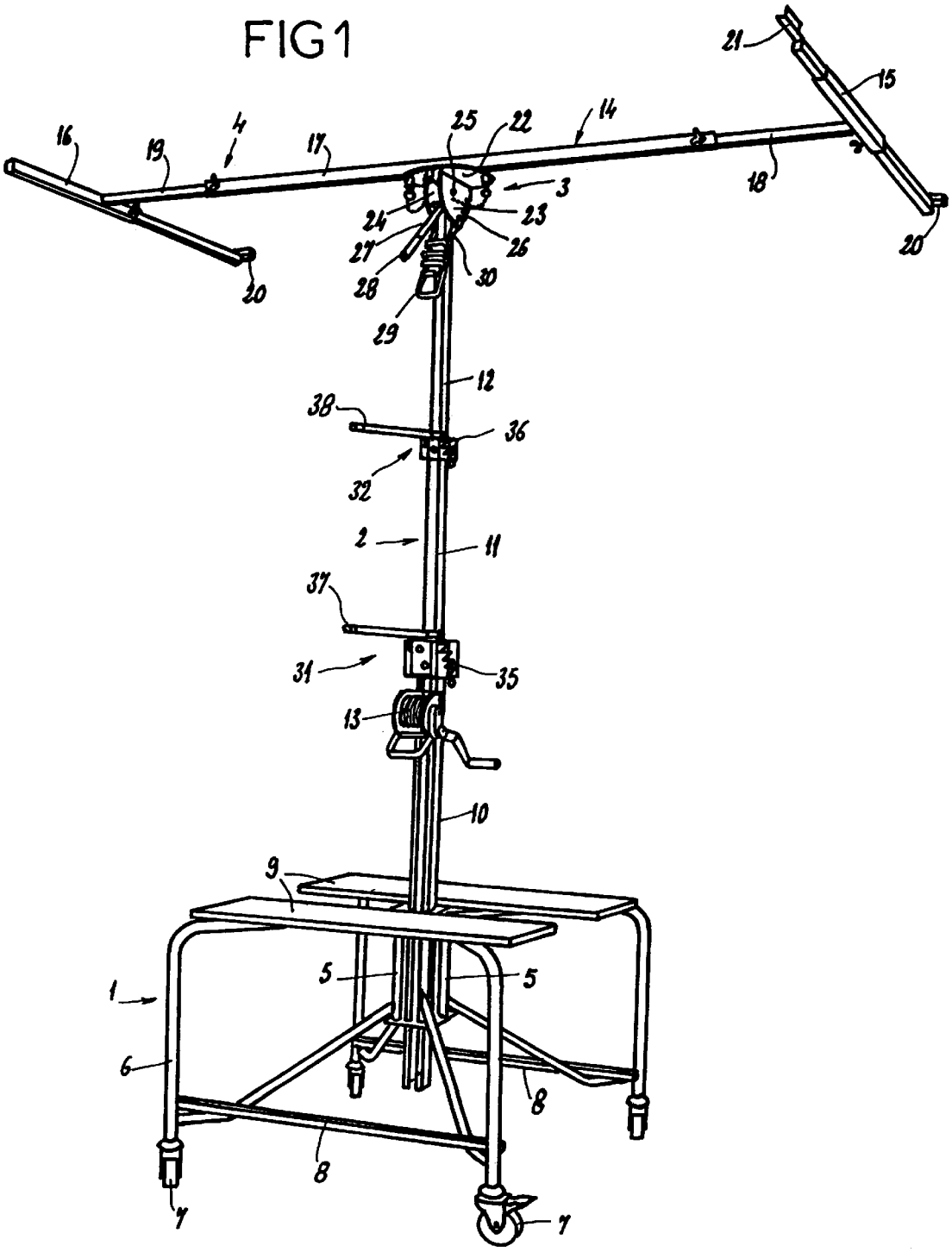
FIG. 1 is a small-scale perspective view of the panel lifter according to the invention.

As seen in FIG. 1 a panel lifter basically comprises a base 1, a central telescoping mast 2, a head 3 at the top of the mast 2, and a panel-support frame 4 carried on the head 3.

The base 1 has a central support 5 on which are hinged four L-shaped arms 6 carrying rollers 7 at their outer lower ends. In the use position of the apparatus the arms 6 extend in planes generally radially of the support 5 with horizontal struts 8 engaged between them to form a stable support for the mast 2. Stage planks 9 supported on the arms 6 allow workers to stand and screw a panel supported on the frame 4 to the ceiling. The arms 6 can be swung together to transport the device or roll it through a narrow doorway.

The telescoping mast 2 is comprised of a lower outer tube or section 10 fixed on the base 1, a middle tube or section 11, and a top inner tube or section 12 on whose upper end the head 3 is mounted. A crank 13 serves to raise and lower the mast sections 11 and 12 by means of a cable 50.

The support frame 4 comprises a central beam or bar 14 and two transverse bars 15 and 16 at its outer ends. The central beam 4 actually comprises a main section 17 fixed to the head 3 and two telescoping end sections 18 and 19 that carry the cross beams 15 and 16. These cross beams 15 and 16 can similarly telescope, and carry at their ends devices 20 and 21 for retaining a panel in place.

The head 3 comprises a generally horizontal disk 22 fixed to the beam section 17 and to which are fixed two toothed semicircular plates 23 and 24 lying in parallel vertical planes flanking the upper end of the mast section 12. A horizontal axle pin 25 extending through the upper end of the section 12 and flu through both plates 23 and 24 allows the whole frame 4 to pivot about an axis parallel to the main beam 14. Each plate 23 and 24 is formed as a sector gear with an arcuate row of teeth 26. A positioning arm 27 fixed to them has an outer end formed as a handle 28. A locking lever 29 is pivoted on the upper end of the section 12 about a horizontal axis 30 just below the two sectors 23 and 24. This lever 29 has two parallel arms that are inter-connected by a detent engageable with the teeth 26 to lock the frame 4 in any of a multiplicity of positions angularly offset relative to the axle 25. This system can therefore be set to hold panels at an acute angle to the horizontal for application to an inclined or cathedral ceiling.

Thus a panel, for instance of gypsum board, can be loaded onto the frame 4 while the mast 2 is in the fully lowered position. Then the crank 13 is actuated to raise the panel and press it against the ceiling. Once the ends of the panel are properly centered on the ceiling joists, the crank 13 is operated to press the panel tightly in place, whereupon the workers can climb on to the stages 9 to screw the panel tightly to the joists. This is standard.

Figure 2:
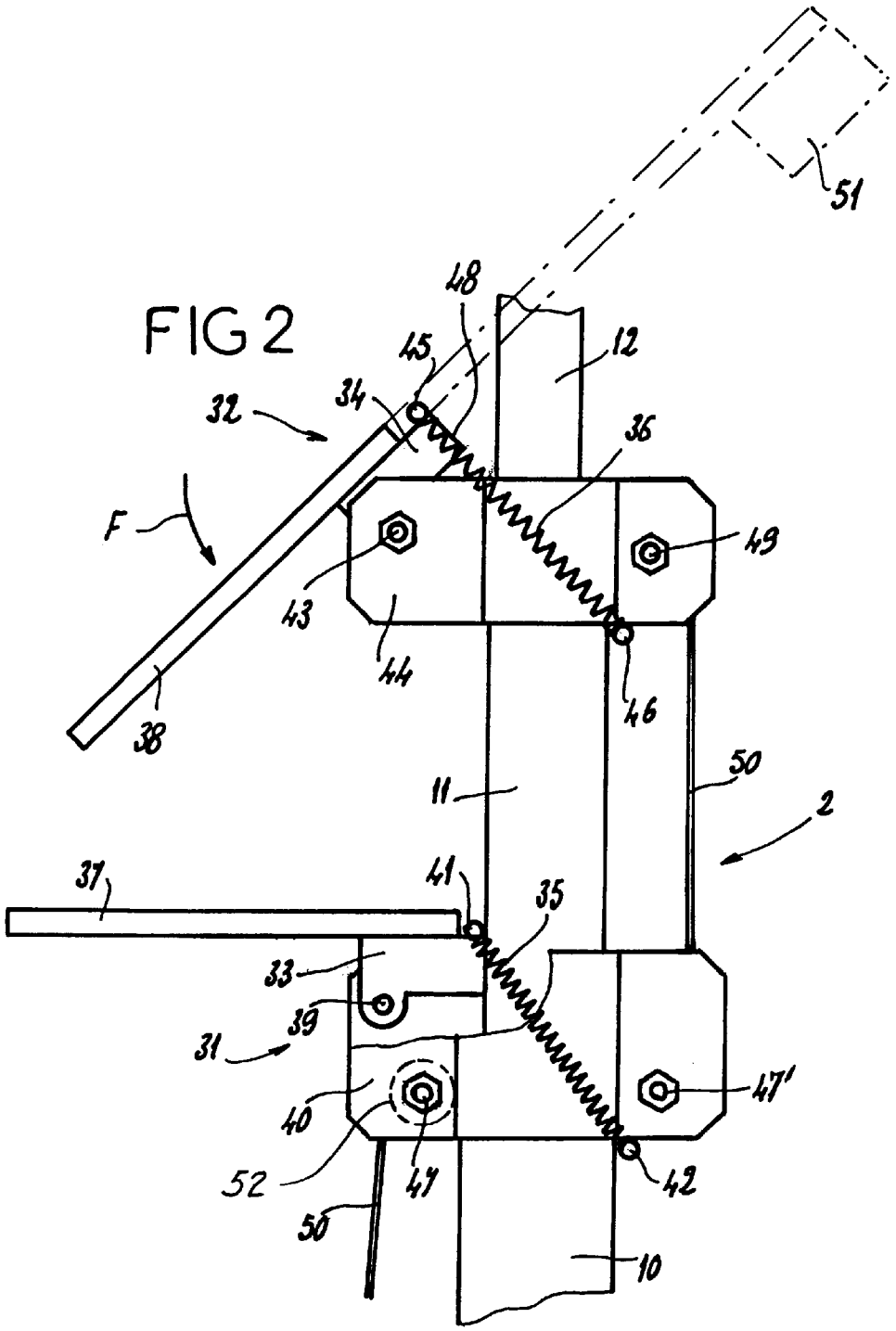
FIG. 2 is a larger-scale side view of a detail of the lifter in accordance with the invention.

In accordance with the invention the lifter has as shown in FIG. 2 two separate brakes 31 and 32, the former acting between the sections 10 and 11 of the mast 2 and the latter between the elements 11 and 12 of the mast 2. The brake 31 has a jaw 33 pivotal about a horizontal axis 39 on a collar 40 fixed at the top of the lower mast section 10, this axis 39 being somewhat offset from this section 10. A lever 37 is welded to the upper face of the jaw 33 and two helical tension springs 35 extend diagonally between a point 41 above the axis 39 on the jaw 33 and a point 42 below the axis 39 on the collar 40. Thus these springs 35 continuously bias the jaw 33 into a position engaging the section 11 and locking the section 11 relative to the section 12.

Similarly the brake 32 has a jaw 34 pivotal about a horizontal axis 43 on a collar 44 fixed at the top of the middle mast section 11, this axis 43 being somewhat offset from this section 11. A lever 38 is welded to the upper face of the jaw 34 and two helical tension springs 36 extend diagonally between a pivot pin 45 above the axis 43 on the jaw 34 and a pivot pin 46 below the axis 43 on the collar 44. Thus these springs 36 continuously bias the jaw 34 into a position engaging the section 12 and locking the section 12 relative to the section 11. FIG. 2 indicates in dot-dash lines how a counterweight 51 can be extended off the rear of the lever 38 to provide biasing force in addition to or instead of the springs 36.

The collars 40 and 44 extend rearward and have axles 47, 47', and 49 that carry wheels 52 over which a lift cable 50 passes. Otherwise the brakes 31 and 32 are independent of the cable 50.

The jaws 33 and 34 each have a large flat surface 48 engageable with the respective mast section 11 or 12 so as to act as a one-way brake. Thus it is possible to raise the mast, with the sections 11 and 12 sliding up past their respective brakes 31 and 32, with no difficulty. Under no circumstances, however, can either of the mast sections 11 or 12 move downward without releasing the respective brake 31 or 32. As a result if the retaining dog normally provided on the crank 13 fails or the cable 50 brakes, the rack 4 will not drop.

In order to lower the rack 4, the user must actuate the levers 37 and 38 as indicated by arrow F in FIG. 2 to disengage the braking surfaces 48 from the sides of the sections 11 and 12. Only then can the rack 4 be lowered. In fact if the crank mechanism is released, the user can quickly lower the rack 4 simply by actuating the levers 37 and 38 one after the other.

I claim:

1. A panel lifter comprising:

a base;

a mast extending upward from the base and including at least one lower section fixed in the base and at least one movable section telescoping with the lower section and having a laterally directed section face;

a panel-support rack mounted at an upper end of the mast;

means including a crank mechanism on the base and a cable connected between the mechanism and the mast for vertically extending the mast by raising the movable mast section upward relative to the base;

a brake jaw at an upper end of the lower section and having a jaw face, the jaw being pivotal about a horizontal axis below the jaw face between a braking position with the jaw face bearing laterally on the section face and a freeing position with the jaw face pivoted back out of contact with the section face;

an actuating handle projecting generally radially of the axis from the jaw, whereby the jaw can be moved between its positions via the handle; and biasing means urging the jaw into the braking position.

2. The panel lifter defined in claim 1 wherein the lower section has at its upper end a collar on which the jaw is pivoted.

3. The panel lifter defined in claim 1 wherein the biasing means includes at least one tension spring having an upper end engaged with the jaw above the axis and a lower end connected to the lower section below the axis.

4. The panel lifter defined in claim 1 wherein the biasing means includes a counterweight mounted on the jaw.

5. The panel lifter defined in claim 1 wherein the lower section has at its upper end a collar on which the jaw is pivoted and carrying at least one wheel over which the cable is reeved.

6. The panel lifter defined in claim 1 wherein the mast includes two such mast sections, namely a middle mast section telescoping with the lower mast section and having the first-mentioned section face and an upper mast section telescoping with the middle mast section and having the upper mast end carrying the rack and a second laterally directed section face, the lifter further comprising:

a second brake jaw at an upper end of the middle section and having a jaw face, the second jaw being pivotal about a second horizontal axis below the respective jaw face between a braking position with the respective jaw face bearing laterally on the second section face and a freeing position with the respective jaw face pivoted back out of contact with the second section face;

a second actuating handle projecting generally radially of the second axis from the second jaw, whereby the second jaw can be moved between its positions via the second handle; and second biasing means urging the second jaw into the respective braking position.

* * * * *